US005312178A

United States Patent [19]

King

[11] Patent Number: 5,312,178

[45] Date of Patent: May 17, 1994

[54] KNIFE RACK AND CUTTING BOARD

[76] Inventor: Donald G. King, 241 Dickson Park Crescent, Mississauga, Ontario, Canada, L5B 1Y5

[21] Appl. No.: 817,084

[22] Filed: Jan. 6, 1992

[30] Foreign Application Priority Data

Jul. 12, 1989 [GB] United Kingdom ..... 8915956

[51] Int. Cl.[5] ..... A47B 96/18

[52] U.S. Cl. ..... 312/140.4; 312/229; 269/289 R

[58] Field of Search ..... 211/70.7; 312/242, 140.4, 312/229, 280; 269/15, 16, 289 R, 302.1

[56] References Cited

U.S. PATENT DOCUMENTS 508,885 0/1893 Johnston .
3,011,849 12/1961 Bishop, Jr. .
3,423,144 1/1969 Patterson ..... 211/70.1
4,318,537 3/1982 Dorman et al. .

FOREIGN PATENT DOCUMENTS 3446621 1/1987 Fed. Rep. of Germany .
2098858 12/1982 United Kingdom .

*Primary Examiner*—Peter R. Brown
*Attorney, Agent, or Firm*—Sim & McBurney

[57] ABSTRACT

An improvement in countertop mounted cutting apparatus comprising a bracket adapted to fit into an opening in the countertop for supporting a cutting board, the bracket including a flange portion overlapping the countertop adjacent the opening, characterized by a knife scabbard adjacent the cutting board and supported by the bracket, the knife scabbard having individual slots of varying lengths to receive knives of varying blade widths.

21 Claims, 6 Drawing Sheets

KNIFE RACK AND CUTTING BOARD

CROSS-REFERENCE TO RELATED APPLICATION

This application is a continuation of application FCT/CA90 00220 filed on Jul. 12, 1990, designating the United States.

TECHNICAL FIELD

This invention relates to a cutting board system which may be mounted in a countertop and more particularly to a cutting board system which may optionally include a knife rack which is readily disassembled for cleaning.

BACKGROUND ART

A variety of cutting boards are available which may be mounted in a countertop. Examples of such cutting boards are disclosed in U.S. Pat. Nos. 3,011,849; 3,013,851 and 4,318,537. All of these structures have in common the use of a metal flashing or the like to bridge the gap between the cutting board mounting structure and the counter edge. Such flashing ensures that extraneous debris does not fall between the mounting structure and the counter edge; hence all liquids and debris remain on top of the cutting board and its structure and about the edges of the structure on the countertop. A variety of mounting devices for the cutting board are provided which ensure that the flashing is securely positioned in bridging the gap between the counter edge and the cutting board. In all of the related structures of these patents the mounting structure is tightened in place by adjusting screws beneath the countertop.

It is appreciated, however, that in many cutting operations common to professional and/or domestic kitchen work considerable liquids may develop. It is therefore desirable to drain away such liquids. Examples of cutting boards which provide for drainage are disclosed in U.S. Pat. Nos. 508,885; 4,041,964 and DES. 259,166. The cutting board of U.S. Pat. No. 508,885 is associated with the side of the board which is normally used for draining of dishes. The drain system is integral with the board structure and would therefore not be suitable for most cutting operations which require the smooth side of the board. When the smooth side is used, the drainage feature is eliminated. U.S. Pat. No. 4,041,964 and DES. 259,166 disclose drainage boards which may be positioned in the sink. Excess liquids may be drained away in perforated baskets or wiped off the board directly into the sink in which the cutting board is mounted.

DISCLOSURE OF THE INVENTION

According to an aspect of this invention, a cutting board mounting system is provided for mounting the cutting board in a countertop. The mounting system includes a bracket comprising a flange portion overlapping the countertop adjacent an opening therein, a depending leg portion connected to the flange and a ledge. The ledge has an upstanding ridge for supporting the underside of the cutting board when placed on the mounting system.

According to another aspect of the invention, a gap may be defined between the edge of the cutting board and the depending leg of the bracket to permit liquids to drain from the board onto the ledge. A suitable drainage system may be coupled to the ledge to drain liquids away from the ledge area as contained in a well defined in the bracket.

According to another aspect of the invention, a cutting board mounting system is provided for mounting a cutting board in a countertop. Adjacent the cutting board and resting on the mounting system is a knife scabbard having individual slots of varying lengths to receive knives of varying blade widths.

The mounting system may be mounted on the countertop in a variety of ways, including friction mounting thereof or mechanical securement by link portion interacting with the bracket.

BRIEF DESCRIPTION OF THE DRAWINGS

Preferred embodiments of the invention are shown in the drawings wherein.

MODES FOR CARRYING OUT THE INVENTION

Figure 1:
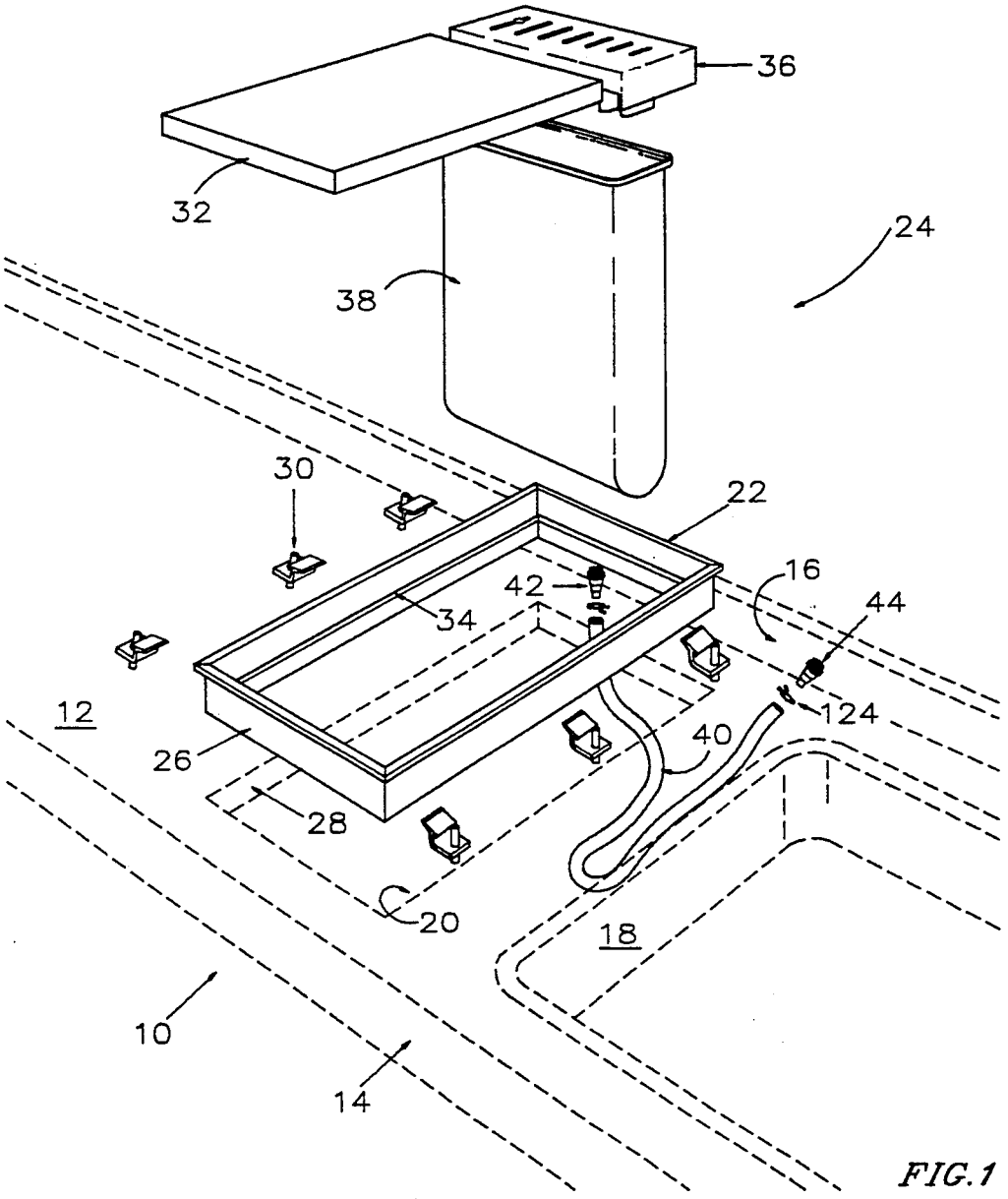
FIG. 1 is an exploded perspective view of the cutting board assembly ready for mounting in the countertop.

A standard type of counter commonly found in kitchen areas is shown in FIG. 1. The counter 10 comprises a countertop 12 with depending front 14 and upstanding backsplash 16. A sink 18 is already provided in the countertop 12 in accordance with standard techniques. To receive the cutting board of this invention, an opening 20 is cut in the countertop of suitable size to receive the mounting bracket 22 of the cutting board system generally designated 24. The depending leg portion 26 of the mounting bracket 22 fits within the perimeter of the opening 20 defined by countertop edges 28. According to an aspect of this invention, the depending leg 26 is loosely received by the countertop edges 28. Six mounting brackets 30 are used to then firmly secure the mounting bracket 22 in place on the countertop in a manner to be discussed in more detail with respect to FIG. 5. A cutting board 32 is then supported by a ledge portion 34 of the mounting bracket. The cutting board may fill the entire space defined by the bracket 22 or it may include a space to permit mounting of a knife rack which consists of a knife scabbard 36 and a knife blade guard 38. When desired, a drain system may be included. The drain system comprises a drainage hose 40 which is coupled to the mounting bracket by way of spigot 42. An additional spigot 44 is used to connect the drainage hose 40 to a suitable liquid containing device or to the drainage system for the kitchen drain.

Figure 2:
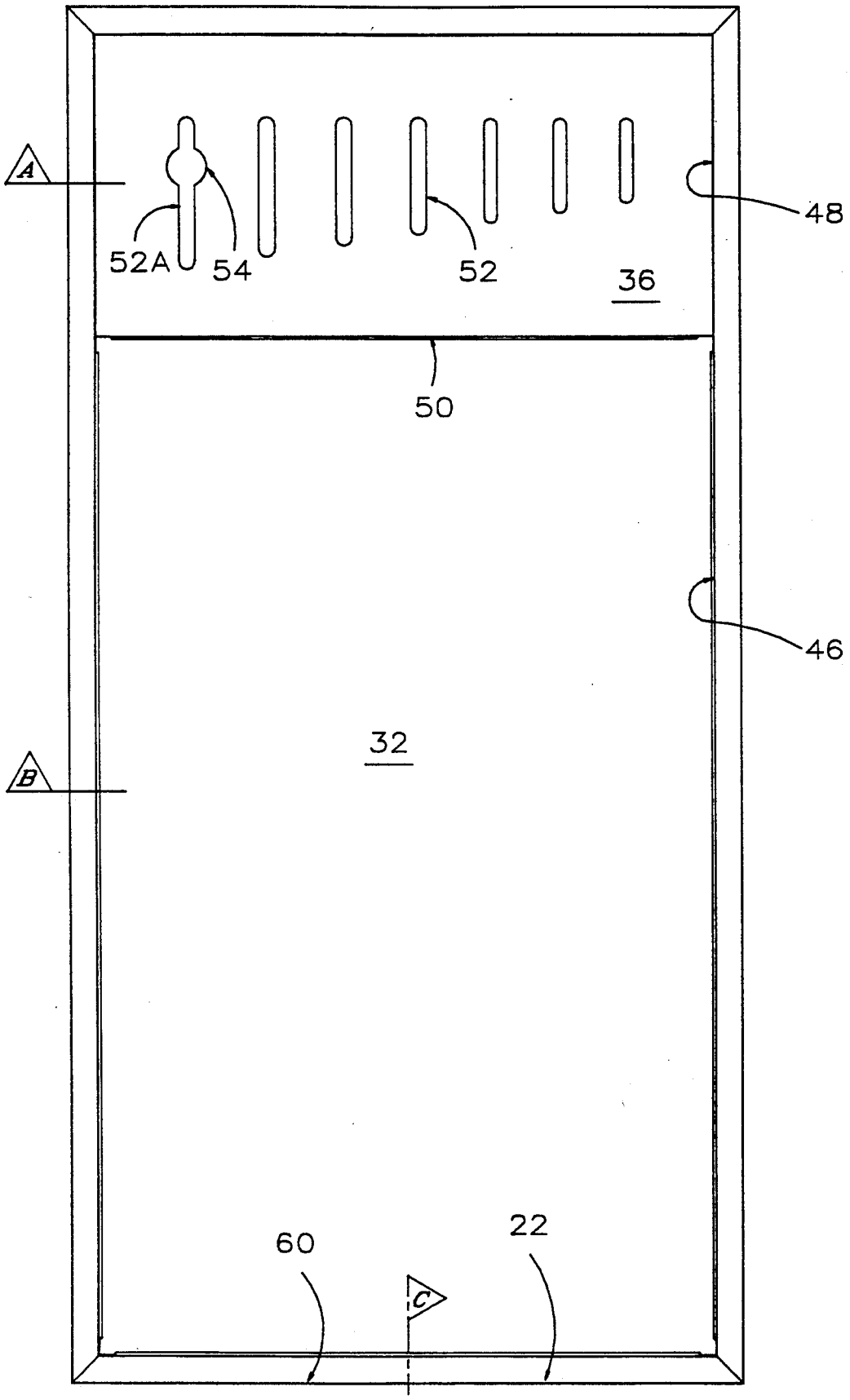
FIG. 2 is a top plan view of the assembled cutting board system.

The assembled cutting board of FIG. 2 demonstrates that the board 32 fits snugly within the inner edge of the depending leg portion 26 of the bracket to define minimal spacing 46 between the edges of the cutting board and the bracket 22. The knife scabbard 36 is of a dimension to also fit snugly between the edge portions 48 and adjacent the cutting board at 50. The knife scabbard consists of individual slots 52 of varying lengths to receive knives of varying blade widths. The largest slot 52a includes an enlarged circular aperture 54 to receive a steel or like device for sharpening knives.

Figure 3:
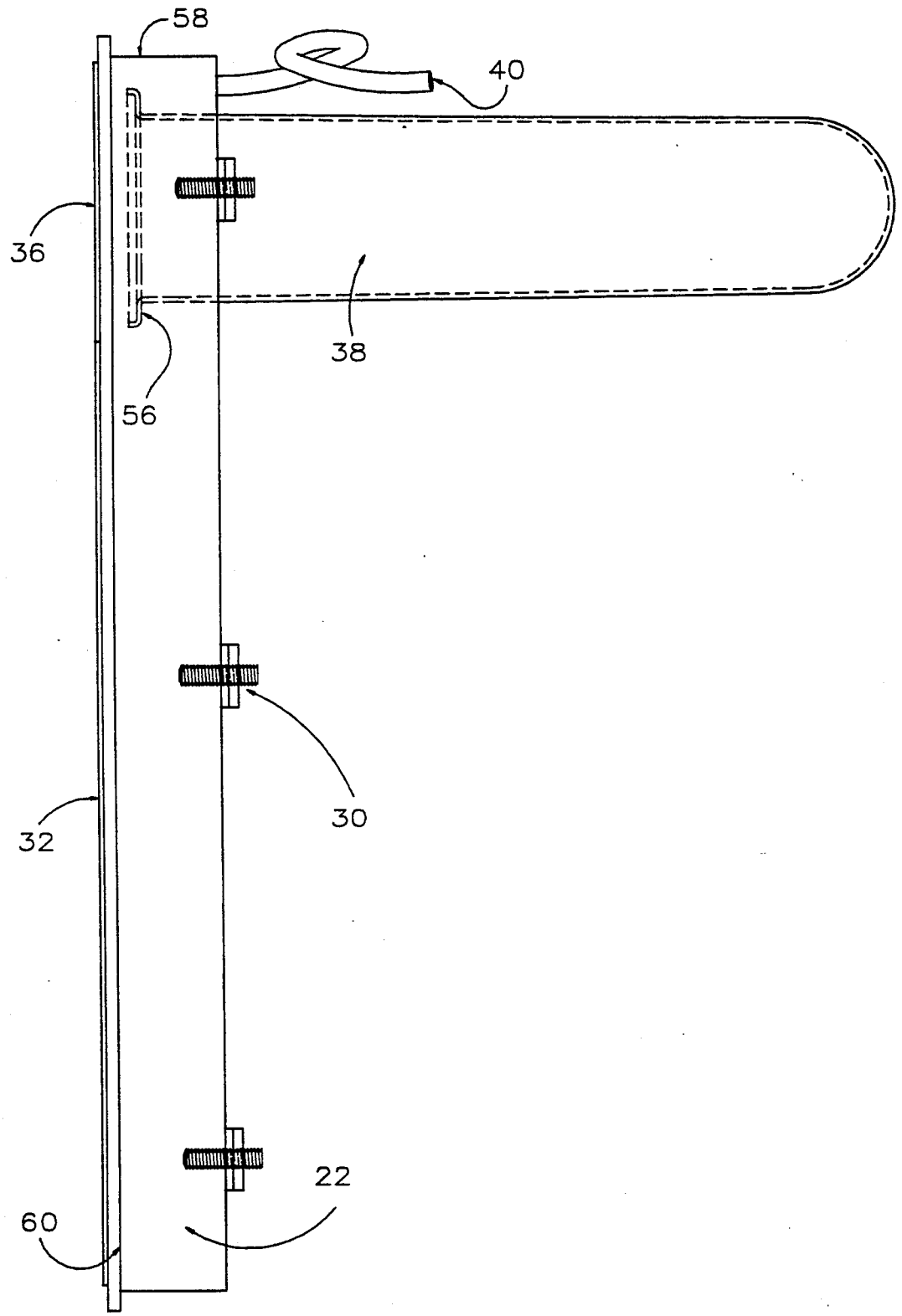
FIG. 3 is a side elevation of the cutting assembly of FIG. 1.
Figure 4:
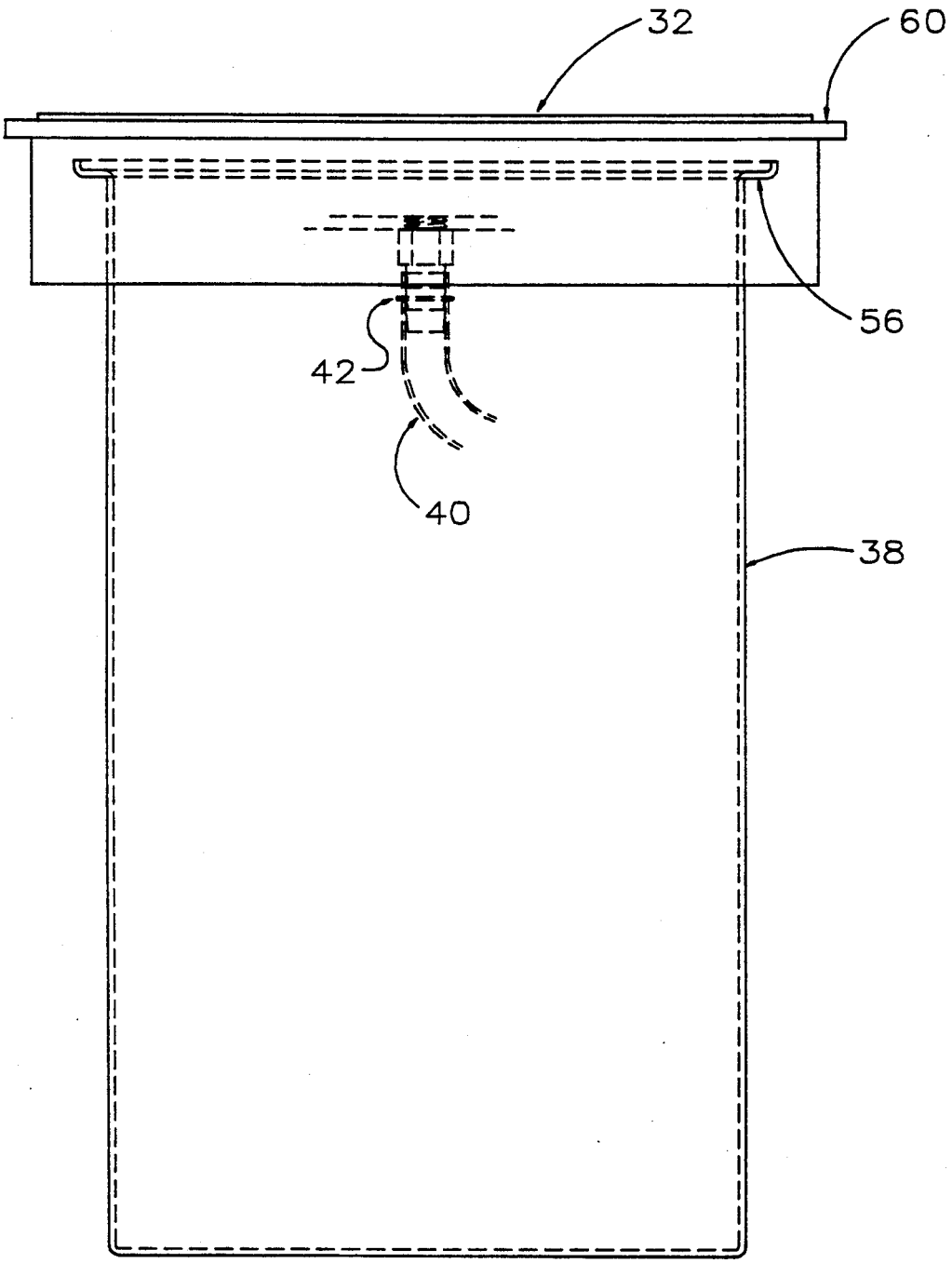
FIG. 4 is an end view of the cutting assembly of FIG. 1.

As shown in the side elevation of FIG. 3, the knives as they extend through the scabbard 36 and are held by their handle portions are housed beneath the cutting board in a knife guard 38. The knife guard is mounted within the perimeter of the bracket 22 by a lip portion 56 supported by the inner ridge portion of the bracket 22. The knife guard 38 is of sufficient depth to accommodate most anticipated blade lengths. When the scabbard is removed from the bracket, the blade guard is readily removed for cleaning. The blade guard may be formed from a variety of moldable materials including plastics. The blade guard may be either blow molded or injection molded and of a plastic which is readily cleaned, such as by a dishwasher.

Figure 5:
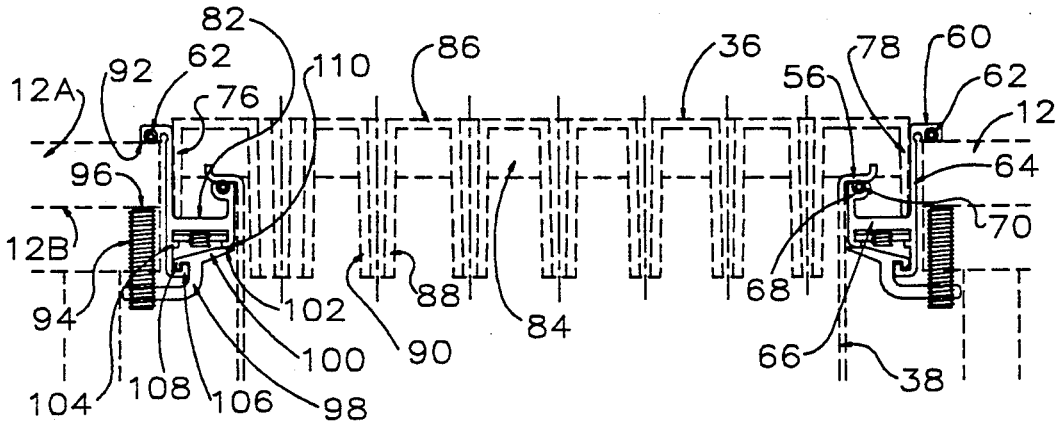
FIG. 5 is a section along line A of FIG. 2.
Figure 6:
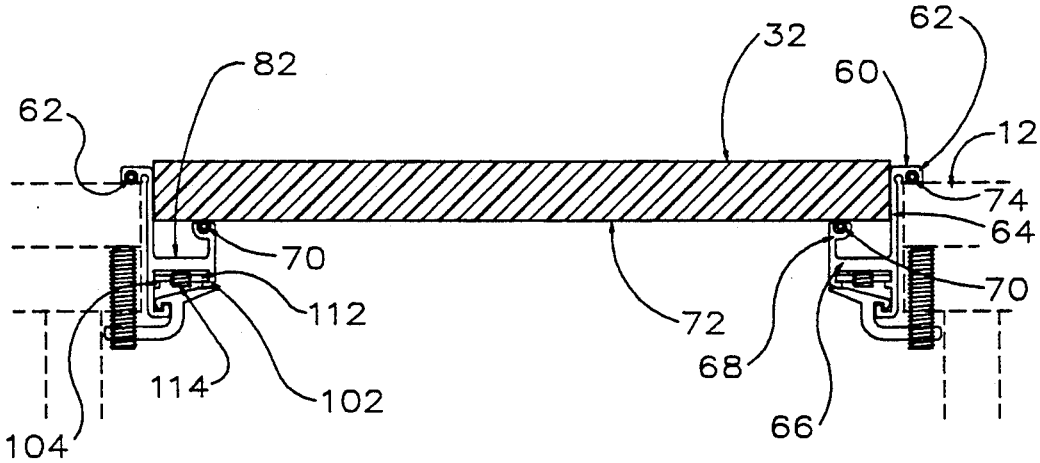
FIG. 6 is a section along line B of FIG. 2.
Figure 7:
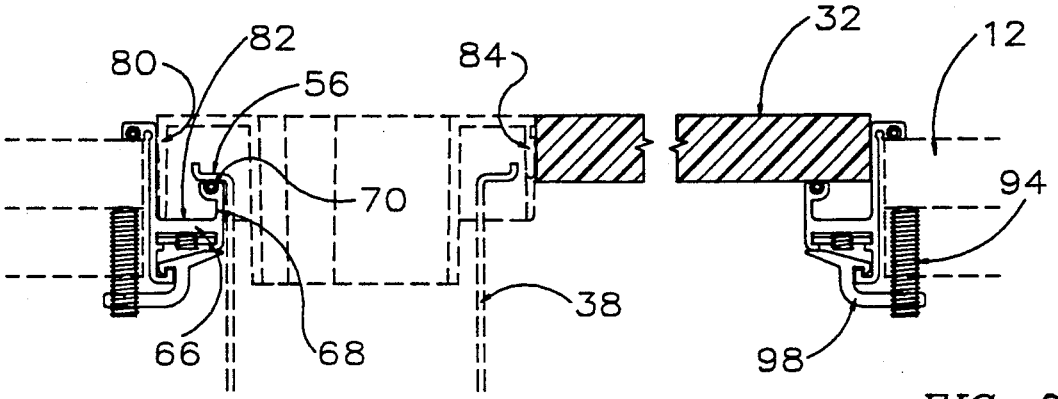
FIG. 7 is a section along line C of FIG. 2.

The drain hose 40, as coupled to the spigot 42, is positioned at an end 58 of the bracket 22. The cutting board 32 may be slightly below the level of the knife scabbard 36. Both elements are slightly above the upper edge 60 of the bracket 22 to facilitate wiping of the surfaces while at the same time providing a relatively flush mounting with the countertop. The details of mounting the bracket and related assemblies of the cutting board in the countertop are shown in FIGS. 5, 6 and 7. According to a preferred aspect of the invention, the bracket 22 consists of interconnected extruded sections of aluminum. Alternatively, the bracket 22 may be fabricated from plastic, stainless steel or any other suitable material. As shown in FIG. 5, the extruded section of aluminum comprises a flange 62 which presents upper surface 60. Optionally, the sections may be of press-formed stainless steel. The flange 62 has a depending leg 64. A ledge 66 is integral with the depending leg and extends outwardly thereof. Extending upwardly from the ledge 66 is a ridge 68, the upper surface of which carries a tubular shape gasket 70 which supports the flange 56 of the knife guard 38. As shown in FIG. 6, the same tubular gasket 70 supports the underside 72 of the cutting board 32. The flange 62 also carries a tubular shaped gasket 74. The gasket 70 and 74 may be formed of extruded rubber or foamed neoprene or solid neogrene. The knife scabbard 36 is supported in the bracket 22 by depending flange portions about its perimeter. As shown in FIGS. 5 and 6, the knife scabbard has opposing depending leg portions 76 and 78. The edge of the knife scabbard remote of the cutting board 32 has a depending leg 80, as shown in FIG. 7. Legs 76, 78 and 80 are all of approximately the same height and rest on the base 82 of the ledge 66. In order to clear the ridge 68, the remaining edge of the knife scabbard adjacent the cutting board 32 has a shorter leg 84 which is above the ridge 68 as shown in FIG. 5. In this manner the knife scabbard is properly supported in the bracket 22. The knife guard 38 is similarly supported on the tubular gasket 70 of the ridge 68, as shown in FIG. 7.

The knife scabbard 36 includes guides extending beneath the upper surface 86 of the scabbard. The guides consist of opposing wall portions 88 and 90 which assist in steadying the knives in the scabbard to ensure that they remain upright in the knife holder.

The bracket 22 is secured to the countertop by sandwiching a countertop edge portion 12a, as shown in FIG. 5, between the underside 92 of the flange 62 and a threaded bolt 94 having an end portion 96 which is threaded onto the underside 12b of the countertop 12. The threaded bolt 94 is threaded into a clip 98. The clip 98 has a wing portion 100 lodged in the bracket 22. Beneath the ledge 82 of the bracket 22 is a channel portion defined by opposing lugs 102 and 104. Beneath lug 104 is a further lug 106 which has a corresponding lug 108 of the wing 100. As the threaded bolt 94 is threaded inwardly towards the underside 12b of the countertop, the clip 98 is swung outwardly away from the countertop underside. Lug 108 pivots about 106 and forces the distal end 110 of the wing against lug 102. With the wing 100 in this position, the underside 92 of the flange 62 is secured against the top of the counter with the counter edge 12a firmly clamped between the flange 62 and the upper edge 96 of the bolt 94.

In order to attach the extruded bracket portions together at their corners, as shown in FIG. 6, the lugs 102 and 104 receive a corner bracket 112 which is L-shaped and fits within each extrusion. A set screw 114 is screwed upwardly against the ledge 82 to bind the corner bracket 112 in place and hence hold the adjacent extrusion sections together. With four of these corner brackets in place, the bracket assembly 22 is completed.

Figure 8:
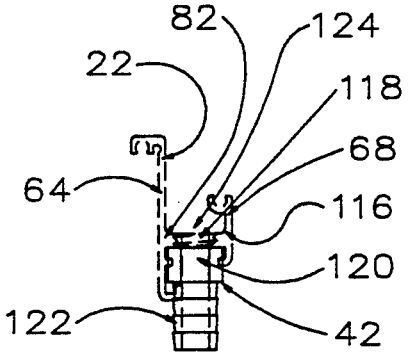
FIG. 8 is a section through the drainage coupling of the cutting board mounting system.

As shown in FIG. 8, the bracket 22 is shown in dot with the ledge portion 82 having a threaded bore 116 provided therein. The spigot 42 has a threaded portion 118 for threading into the bore 116. The spigot 42 may be tightened in place by using wrench flats 120. The hose is placed over the stepped spigot portion 122 and secured in place by a suitable tube locking ring, such as 124 shown in FIG. 1. The upper end of the spigot threaded portion is flush or beneath the level of the ledge 82. The bracket 22 has a well defined between the ridge 68 and the depending leg portion 64. Liquids that drain down the edge of the cutting board may be collected in this well, generally designated 124. As the liquids collect in the well about the bracket, the liquids drain towards the spigot 42 and be carried away by the tube 40. Hence depending upon the use of the cutting board system, the actual board 32 may be dimensioned to leave sufficient space to allow liquids to drain between the board edge and the depending leg portion 64, or optionally the board may be cut to fit snugly with the depending leg portion 64 of the bracket 22. When drainage is not desired a plug may be inserted in the threaded bore 116. The well 124 may be cleaned from time to time by simply lifting the cutting board 32 from the supporting bracket 22.

Other embodiments or modifications of the invention are possible within the scope of the claims appended hereto. For example, the bracket 22 may include a bottom extending from the ledge across the opening as to form a tray with a moat for drawing liquid toward a drainage coupling disposed within a further ledge connecting the well 124 and extending across the opening below the adjacent edges of the cutting board and knife scabbard.

I claim:

1. An improvement in apparatus for mounting a cutting board in a countertop, said apparatus being adapted to fit into an opening in said countertop for supporting said cutting board, said apparatus including a flange portion overlapping the countertop adjacent said opening, characterized by a depending leg portion connected to said flange portion, a ledge extending from said depending leg portion, said ledge extending inwardly relative to said opening, and an upstanding ridge projecting from said ledge for supporting the underside of the cutting board when placed thereon, a knife scabbard adjacent said cutting board and supported on said ledge, said knife scabbard having individual slots of varying lengths to receive knives of varying blade widths, further characterized by a gap between the edge of said cutting board and said depending leg portion to permit draining of liquids from said cutting board onto said ledge, and a drainage coupling connected to said ledge for draining said liquids away from said ledge area.

2. The improvement of claim 1 further characterized by a knife guard surrounding said knives and supported on said upstanding ridge.

3. The improvement of claim 2 wherein said knife guard further comprises a lip portion extending around the periphery at the top thereof adapted to be supported by said upstanding ridge.

4. The improvement of claim 1 wherein said ledge further includes a threaded bore, and said drainage coupling comprises a spigot having a threaded portion adapted for threading into said threaded bore within said ledge, a hose adapted to fit over the spigot for draining away said liquids, and a tube locking ring for securing connection of said hose to said spigot.

5. The improvement of claim 2 wherein said apparatus is fabricated from extruded aluminum.

6. The improvement of claim 2 wherein said apparatus is fabricated from injection moulded plastic.

7. The improvement of claim 1 wherein said knife scabbard further comprises a plurality of guides extending beneath the upper surface of said scabbard consisting of opposing wall portions for steadying the knives within the scabbard to ensure that the knives remain in an upright orientation.

8. An improvement in countertop mounted cutting apparatus for supporting a cutting board and adjacent knife scabbard having individual slots of varying lengths to receive knives of varying blade widths, comprising a bracket adapted to fit into an opening in said countertop, said bracket including a flange portion overlapping the countertop adjacent said opening, wherein said bracket further comprises a depending leg portion connected to said flange portion, a ledge extending from said depending leg portion inwardly of said opening, and an upstanding ridge projecting from said ledge for supporting the underside of the cutting board and knife scabbard when placed thereon.

9. The improvement of claim 8 further characterized by a gap between the edge of said cutting board and said depending leg portion to permit drainage of liquids from said cutting board onto said ledge, and a drainage coupling connected to said ledge for draining said liquids away from said ledge area.

10. The improvement of claim 8 further characterized by a knife guard surrounding said knives and supported on said upstanding ridge.

11. The improvement of claim 10 wherein said knife guard further comprises a lip portion extending around the periphery at the top thereof adapted to be supported by said upstanding ridge.

12. The improvement of claim 8 wherein said ledge further comprises a pair of downwardly extending lugs defining a channel portion, and further characterized by a plurality of mounting bracket for securing said bracket to said countertop, each of said mounting brackets comprising a bolt threaded onto a clip and adapted to be threaded toward the underside of said countertop, the clip having a wing portion adapted to engage said pair of lugs and pivot within said channel portion beneath said ledge responsive to inward threading of said bolt, thereby clamping said countertop between the bolt and said flange portion.

13. The improvement of claim 8 wherein said bracket is fabricated from extruded aluminum.

14. The improvement of claim 8 wherein said bracket is fabricated from injection moulded plastic.

15. The improvement of claim 8 further characterized by a first gasket disposed within said flange portion, and a second gasket disposed within said upstanding ridge.

16. An improvement in apparatus for mounting a cutting board in a countertop, said apparatus being adapted to fit into an opening in said countertop for supporting said cutting board, said apparatus including a flange portion overlapping the countertop adjacent said opening, characterized by a depending leg portion connected to said flange portion, a ledge extending from said depending leg portion, said ledge extending inwardly relative to said opening, said ledge having a pair of downwardly extending lugs defining a channel portion, and an upstanding ridge projecting from said ledge for supporting the underside of said cutting board when placed thereon, a knife scabbard adjacent said cutting board and supported on said ledge, said knife scabbard having individual slots of varying lengths to receive knives of varying blade widths, a plurality of mounting brackets for securing said apparatus to said countertop, each of said mounting brackets comprising a bolt threaded onto a clip and adapted to be threaded toward the underside of said countertop, the clip having a wing portion to engage said pair of lugs and pivot within said channel portion beneath said ledge responsive to said inward threading of said bolt, thereby clamping said countertop between the bolt and said flange portion.

17. The improvement of claim 16 wherein said apparatus is fabricated from extruded aluminum.

18. The improvement of claim 16, wherein said apparatus is fabricated from injection moulded plastic.

19. An improvement in apparatus for mounting a cutting board in a countertop, said apparatus being adapted to fit into an opening in said countertop for supporting said cutting board, said apparatus including a flange portion overlapping the countertop adjacent said opening, characterized by a depending leg portion connected to said flange portion, a ledge extending from said depending leg portion, said ledge extending inwardly relative to said opening, and an upstanding ridge projecting from said ledge for supporting the underside of the cutting board when placed thereon, a knife scabbard adjacent said cutting board and supported on said ledge, said knife scabbard having individual slots of varying lengths to receive knives of varying blade widths, further characterized by a first gasket disposed within said flange portion, and a second gasket disposed within said upstanding ridge.

20. An improvement in countertop mounted cutting apparatus for supporting a cutting board and adjacent knife scabbard having individual slots of varying lengths to receive knives of varying blade widths, comprising a bracket adapted to fit into an opening in said countertop, said bracket including a flange portion overlapping the countertop adjacent said opening, a depending leg portion connected to said flange portion, a ledge extending from said depending leg portion inwardly of said opening, and an upstanding ridge projecting from said ledge for supporting the underside of the cutting board and knife scabbard when placed thereon, a gap between the edge of said cutting board and said depending leg portion to permit drainage of liquids from said cutting board onto said ledge, and a drainage coupling connected to said ledge for draining said liquids away from said ledge, wherein said knife scabbard further comprises a plurality of guides beneath the upper surface of said scabbard consisting of opposing wall portions for steadying the knives within the scabbard to ensure that the knives remain in an upright orientation.

21. The improvement of claim 20 wherein said ledge further includes a threaded bore, and said drainage coupling comprises a spigot having a threaded portion adapted for threading into said threaded bore within said ledge, a hose adapted to fit over the spigot for draining away said liquids, and a tube locking ring for securing connection of said hose to said spigot.

* * * * *